US005288065A

United States Patent [19]

Wyssmuller

[11] Patent Number: 5,288,065

[45] Date of Patent: Feb. 22, 1994

[54] METHOD FOR SEPARATING SHEETS OF PAPER STACKED IN REAMS AND DEVICE FOR IMPLEMENTING THIS METHOD

[75] Inventor: Philippe Wyssmuller, Cheseaux, Switzerland

[73] Assignee: De la Rue Giori S.A., Lausanne, Switzerland

[21] Appl. No.: 19,150

[22] Filed: Feb. 17, 1993

[30] Foreign Application Priority Data

Mar. 6, 1992 [CH] Switzerland ..... 725/92

[51] Int. Cl.[5] ..... B65H 3/46

[52] U.S. Cl. ..... 271/105; 271/146; 271/161

[58] Field of Search ..... 271/105, 146, 161

[56] References Cited

U.S. PATENT DOCUMENTS

| | | | |
|---|---|---|---|
| 1,710,706 | 4/1929 | Maxner | 271/105 |
| 3,321,078 | 5/1967 | Treiber | 271/161 |
| 3,720,407 | 3/1973 | Woodward | 271/161 |
| 4,306,684 | 12/1981 | Peterson | 271/105 |
| 4,349,186 | 9/1982 | Nakamura | 271/161 |
| 4,854,569 | 8/1989 | Mizuta | 271/105 |
| 5,082,271 | 1/1992 | Mohr | 271/161 |

FOREIGN PATENT DOCUMENTS

| | | | |
|---|---|---|---|
| 0021396 | 5/1983 | European Pat. Off. . | |
| 516165 | 1/1931 | Fed. Rep. of Germany . | |
| 2641214 | 5/1977 | Fed. Rep. of Germany . | |
| 112537 | 6/1985 | Japan | 271/161 |
| 308034 | 12/1989 | Japan | 271/161 |
| 098926 | 4/1991 | Japan | 271/161 |
| 1003975 | 3/1983 | U.S.S.R. | 271/161 |
| 1003976 | 3/1983 | U.S.S.R. | 271/161 |

*Primary Examiner*—David H. Bollinger

*Attorney, Agent, or Firm*—Kane, Dalsimer, Sullivan, Kurucz, Levy, Eisele & Richard

[57] ABSTRACT

The method consists, while the ream is applied against a curved surface, in exerting pressure forces against the outer sheet of said ream, along a line of application parallel to the generatrices of the curved surface, moving this line over the entire length of the ream, and beyond each of the edges of the sheets, thereby releasing the sheets. The intensity of the pressure forces enables the sheets to be kept against the curved surface and the speed of movement of the line of application is adjusted in order for the released sheets successively to move away from the remaining curved sheets, thereby reestablishing a plane ream, this reformed ream being jogged.

9 Claims, 3 Drawing Sheets

METHOD FOR SEPARATING SHEETS OF PAPER STACKED IN REAMS AND DEVICE FOR IMPLEMENTING THIS METHOD

FIELD OF THE INVENTION

The present invention relates to a method for separating sheets of paper stacked in reams of sheets by applying the ream against a curved surface in order to separate the sheets of this ream, especially printed sheets, preferably loan papers, and devices for implementing this method.

PRIOR ART

In Patent DE-B 2,641,214, such a device is described for separating the reams of sheets. This device is mounted in the path of the reams and is composed of at least one pair of transporting rollers forming between them a gap through which the reams of sheets pass, the width of this gap being less than the thickness of the ream, and the lining of at least one of these rollers being made from elastic material.

The handling of paper in printing works increasingly poses problems connected with the increase in the productivity of the machines. Whilst considerable efforts have been made in improving the various printing phases, the operations for separating the sheets of a ream before the latter is brought to a feed of a printing machine or to another treatment device have remained among the poor relations of innovation. Thus printers still handle currently by hand quantities of paper which daily are measured in tons.

Between the various operations, buffer stocks of a greater or lesser size are constituted, generally in the form of reams or stacks, typically comprising 250, 500 or 1000 sheets. The transfer of these reams of sheets from one treatment device to the next is generally performed on palettes having several reams. Automatic palletizing, carriage guiding and automated storage systems are known in the prior art. One of the main difficulties in automating the chains of current devices for treating the sheets of paper therefore results from the handling of the paper in the transfer of the reams from the palette onto a feed, while separating the sheets, especially the sheets of loan paper. This operation is currently carried out by operators who separate the sheets of a ream from each other, by bending their edges, aerate them and jog them by hand, before supplying the feed of the printing unit or another treatment device.

The object of the present invention is to permit the automation of the separating operation.

SUMMARY OF THE INVENTION

This object is achieved by virtue of a method in which the ream is applied against a curved surface in order to separate the sheets of this ream by exerting pressure forces against the outer sheet of said ream along at least one line of application parallel to the generatrices of the curved surface, said line of application is moved perpendicularly to the generatrices of the curved surface over the entire length of the ream and then beyond each of the edges of the sheets, thereby releasing the sheets, the intensity of said pressure forces remaining sufficient, during their movement, to keep the sheets against the curved surface, the speed of said movement being adjusted so that the released sheets successively move away from the remaining curved sheets, thereby re-establishing a plane ream, and this formed ream is jogged.

A device according to the invention for implementing the above method, which comprises

- a jogging table comprising, in the middle, an openable zone,
- a deforming cylinder located at some distance above this table and the generatrices of which are substantially parallel to the plane of this table,
- movable pressure means comprising at least two rotary and movable separating rollers, the axis of rotation of which is parallel to the generatrices of said deforming cylinder, these rollers being installed in order to be moved with respect to the deforming cylinder from an initial position below the ream into said openable zone of the table, over trajectories parallel to the surface of the cylinder and in order also to be moved in the radial direction with respect to said cylinder;
- control means for controlling the movements of said separating rollers,
- means for insufflating air directed against the edges of the released sheets parallel to the generatrices of said cylinder and
- jogging means.

Preferred embodiments of the method and device are described in the dependent claims.

The device according to the invention therefore ensures, after installing a ream on the board, the following functions:

- separating the sheets of a complete ream (typically 500 or 1000 sheets) by sliding the sheets over each other, during the deformation of the ream applied against the deforming cylinder,
- aeration of the paper when the separating rollers release the sheets, sheet by sheet, and when they land on the board,
- shaping a ream by jogging against a rim of the board.

The shaping of the stack of sheets landed in a ream of irregular outlines may be carried out by tilting the board and jogging by a hydraulic system or by a cam, or by any jogger known in the state of the art.

BRIEF DESCRIPTION OF THE DRAWINGS

The present invention will be better understood by virtue of the description of a preferred embodiment and of the figures which accompany it, in which.

The elements described are designated by the same reference numbers in all the figures.

DESCRIPTION OF THE PREFERRED EMBODIMENT(S)

Figure 1:
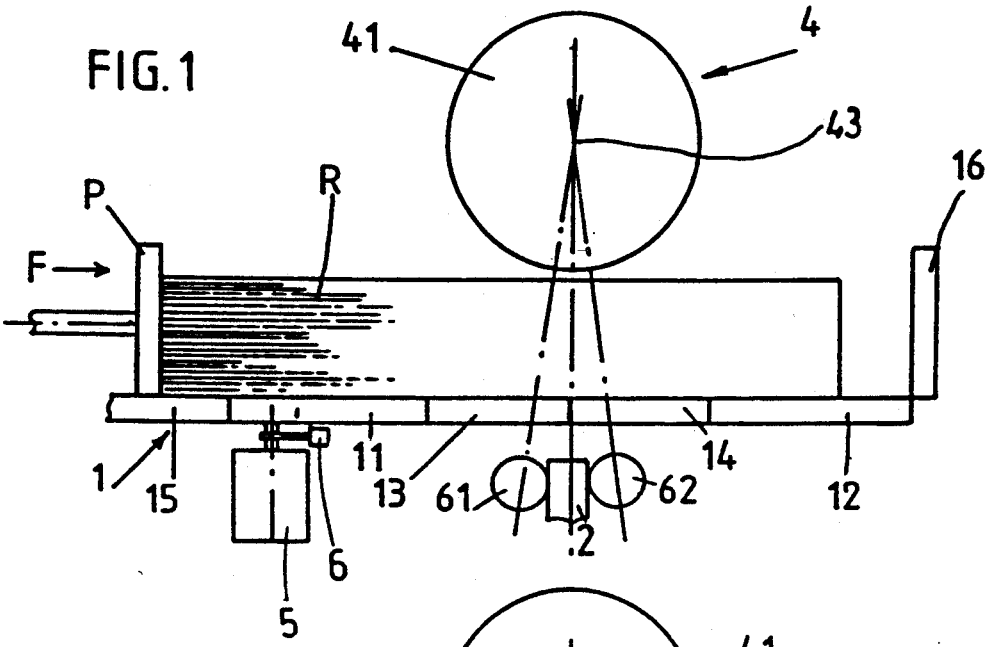
FIG. 1 shows diagrammatically a view of a device for separating the sheets in the phase of arrival of a ream onto the board of the jogging table.
Figure 2:
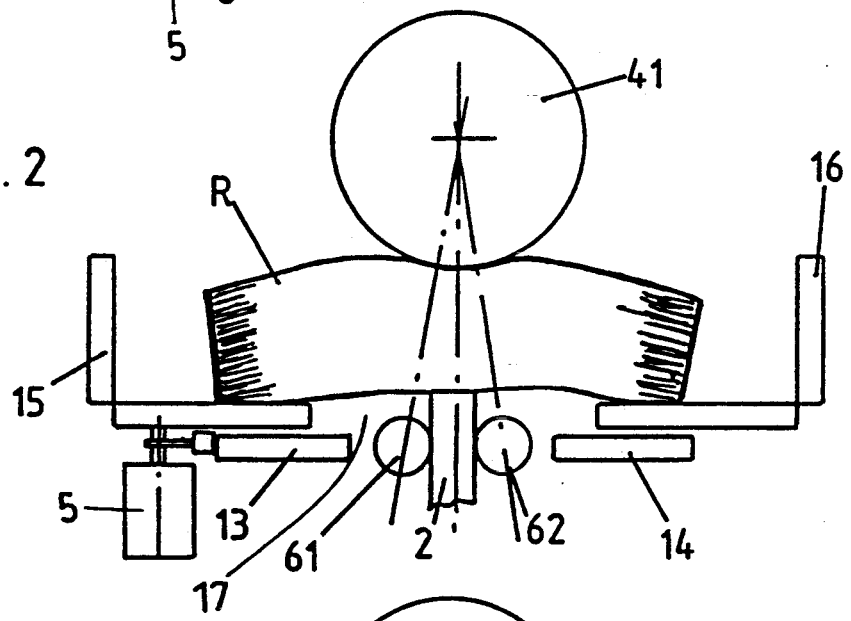
FIG. 2 shows the same device during the application of the ream against the deforming cylinder and the start of the movement of the separating rollers.
Figure 3:
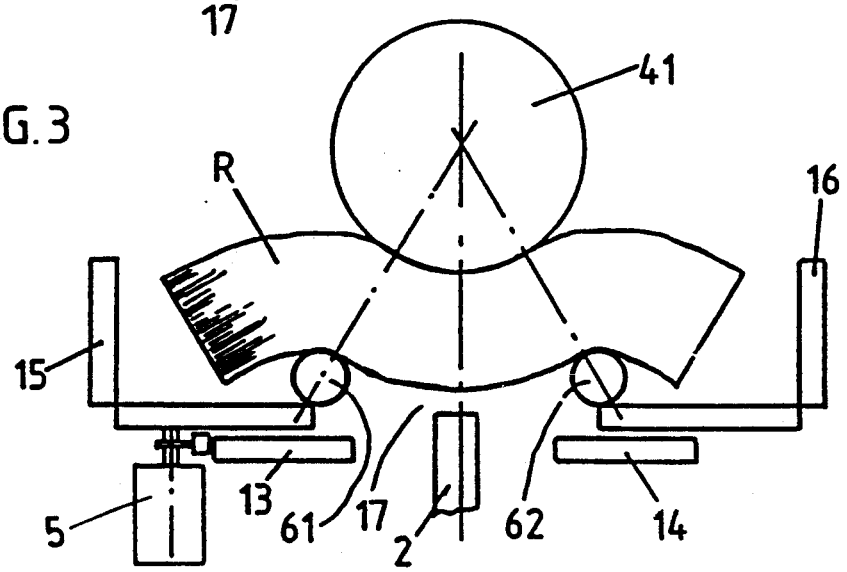
FIG. 3 shows the continuation of the movement of the separating rollers.

The jogging table includes a board 1, composed of stationary elements 11, 12, and of movable elements 13, 14, 15, 16. In the center of the board, the movable elements 13 and 14 can take up a position aligned with the elements 12 and 15 in order to form a continuous support for a ream R of sheets, as shown in FIG. 1, or can be moved below the stationary elements 11, 12 in order to leave an open zone 17 (FIGS. 2 and 3). Below the center of the board 1 is a retractable part in the form of a piston 2 and, on either side of the latter, there are two rollers 61 and 62. The open zone 17 is sufficient for allowing these rollers 61, 62 and this piston 2, which is able to move in the vertical direction, to pass. The movable elements 15, 16 form, in their vertical position, lateral walls of the board. The entire board 1 may be tilted with the aid of a hydraulic jack 3 (FIG. 5) which lowers the stationary element 12.

A motor 5, fixed below the stationary element 11 and driving an unbalanced mass 6 which vibrates the board 1, is provided in order to jog the ream, after the separating operation, in its position illustrated in FIG. 5.

Figure 5:
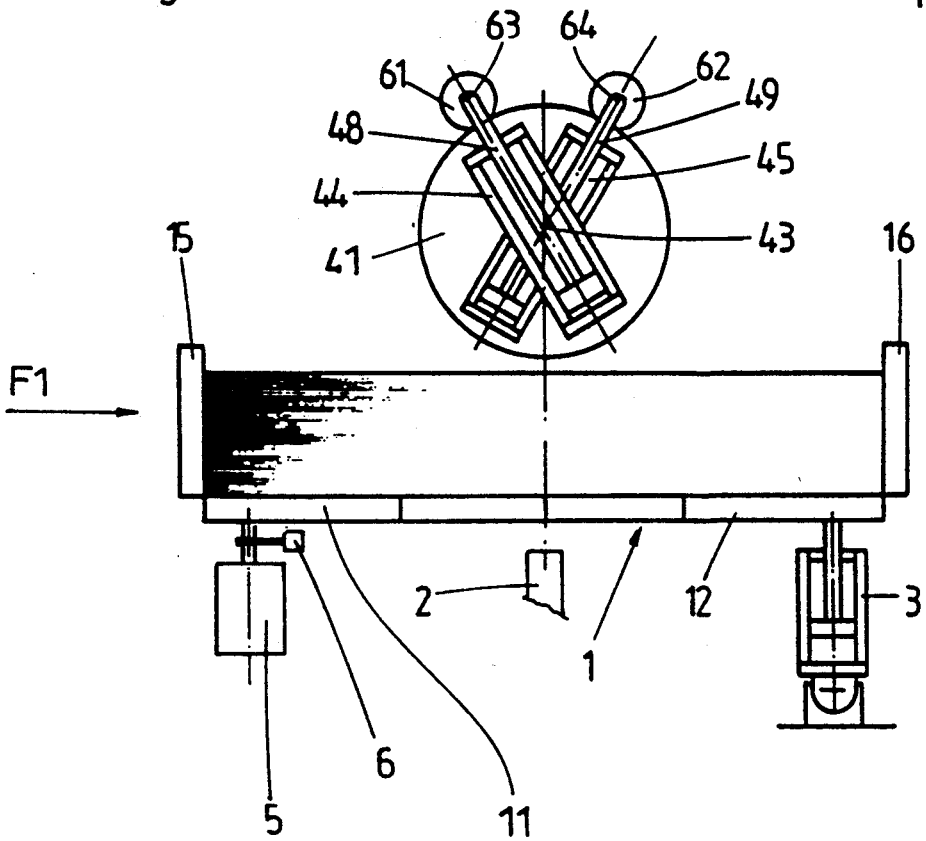
FIG. 5 shows the device during the jogging operation with the mechanism for moving the rollers.
Figure 6:
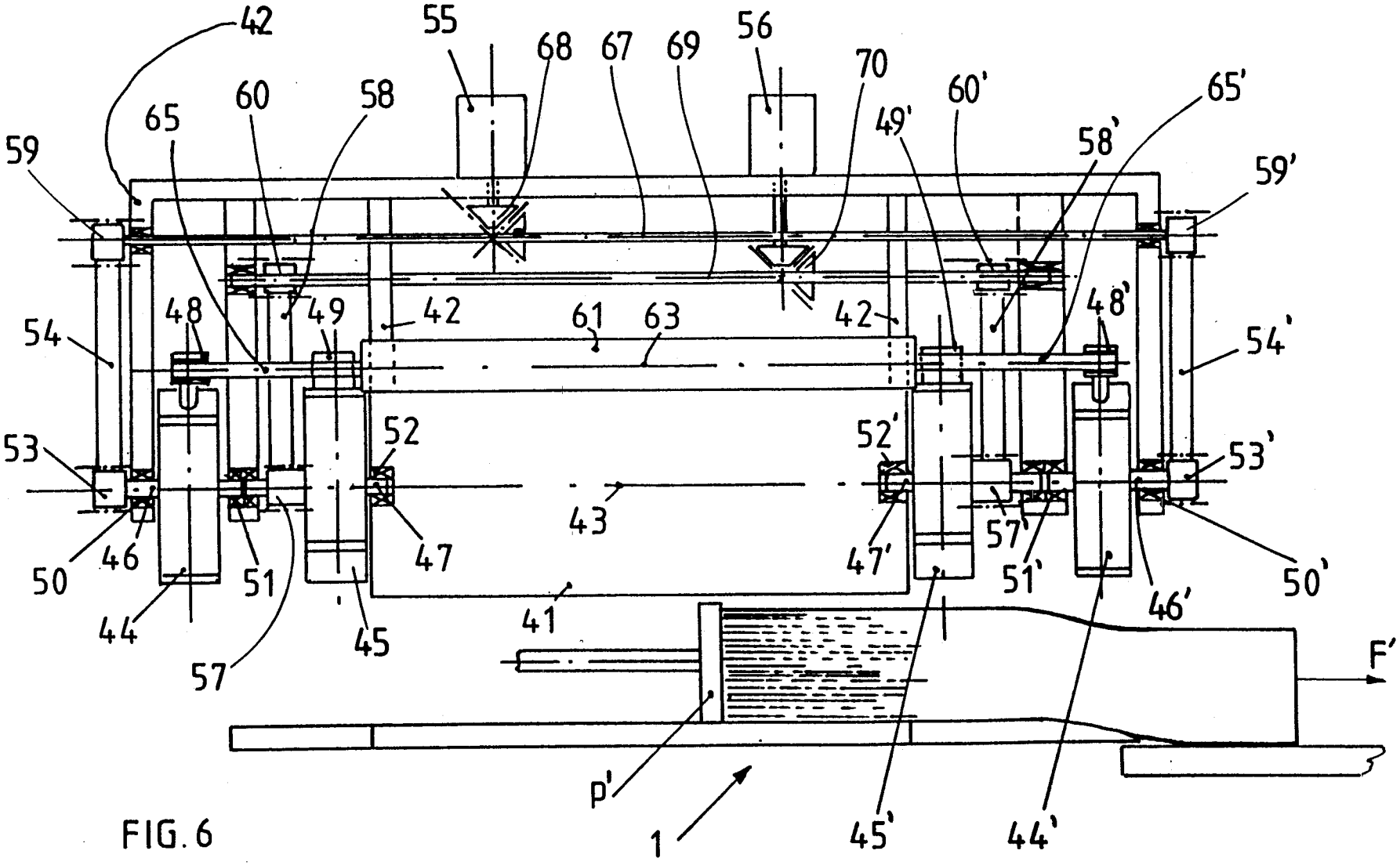
FIG. 6 shows the device in the direction of the arrow F1 of FIG. 5 during the transfer of the ream reformed on a feed table.

The separating device 4 comprises a deforming cylinder 41, mounted in a frame 42 (FIG. 6) which carries, on one of the sides of the cylinder 41, two jacks 44, 45 with their piston rods 48, 49 (FIGS. 5 and 6) and, on the other side of the cylinder 41, two jacks 44', 45', with their piston rods 48' 49' (FIG. 6). All these jacks are mounted on the frame 42 so as to rotate about the same axis, coaxial with the axis 43 of the cylinder 41, and are equipped, for this purpose, with journals 46, 46' and 47, 47' respectively, forming but a single component with the casings of the corresponding jacks and being perpendicular to the axis of the corresponding rod 48, 48' and 49, 49' respectively.

The journals 46 and 47 are housed in the frame 42 and are free to rotate by means of rolling bearings 50, 51 and 52, the bearing 51 in the middle being common to the two jacks 44, 45. On the other side of the cylinder 41, the journals 46' and 47' are housed in the rolling bearings 50', 51' and 52', the bearing 51' in the middle being common to the two jacks 44' and 45'.

The jack rods 48, 48' and 49, 49' carry, according to FIGS. 5 and 6, separating rollers 61 and 62 respectively, which are free to rotate about their axes 63 and 64 and extend parallel to the axis 43 of the cylinder 41.

For this purpose, the separating roller 61 is equipped, on either side, with journals 65, 65' housed so as to rotate in bearings provided in said rods 48 and 48'. In a similar manner, the separating roller 62 is equipped with journals, not seen in FIG. 6 (hidden by the journals, 65, 65'), these journals being housed in bearings for the rods 49, 49' of the jacks 45, 45'.

Two motors, 55 and 56 respectively, fixed to the upper part of the frame 42, are provided in order to drive the jacks 44, 44' and 45, 45' rotationally. The journals 46, 46' of the jacks 44, 44' are prolonged by two pulleys 53, 53' driven by the belts 54, 54' of the first motor 55. In this manner, the motor 55 can drive the jacks 44, 44' about the axis 43 of the cylinder 41, driving the separating roller 61 around the cylinder 41 on which it rolls. In the example in question, the movement of the motor 55 is transmitted to the belts 54, 54' by means of two bevel gears 68 and of a transmission shaft 67 to the ends of which pulleys 59, 59', receiving said belts 54, 54', are fixed. The same drive system is provided for rotating the jacks 45, 45' about the axis 43 driving the separating roller 62; this system includes the motor 56, two belts 58, 58' and two pulleys 57, 57' fixed to the journals 47, 47'. In the same manner, the transmission of the movement of the motor 56 to the belts 58, 58' is performed by two bevel gears 70 and a transmission shaft 69 carrying, at its ends, the pulleys 60, 60'.

By virtue of this configuration, the rollers 61, 62 may be moved, on the one hand, in the radial direction with respect to the cylinder 41 under the effect of the jacks 44, 44' and 45, 45' respectively and, on the other hand, about the cylinder 41 in the angular direction on trajectories coaxial with the cylinder 41 and parallel to its surface. These movements of the rollers around the cylinder 41 may be simultaneous, preferably symmetrical in opposite directions, or independent of each other, the movements being effected successively.

The essential phases of the separating, aerating and jogging operations are shown successively in FIGS. 1 to 6:

In FIG. 1, the elements 13, 14 and 15 of the board are aligned with the stationary elements 11 and 12; the piston 2 and the rollers 61 and 62 are in their low position. The ream R of the sheets is pushed in the direction of the arrow F against the raised element 16 with the aid of the pusher P, thereby centering it approximately below the axis 43 of the cylinder 41.

Figure 4:
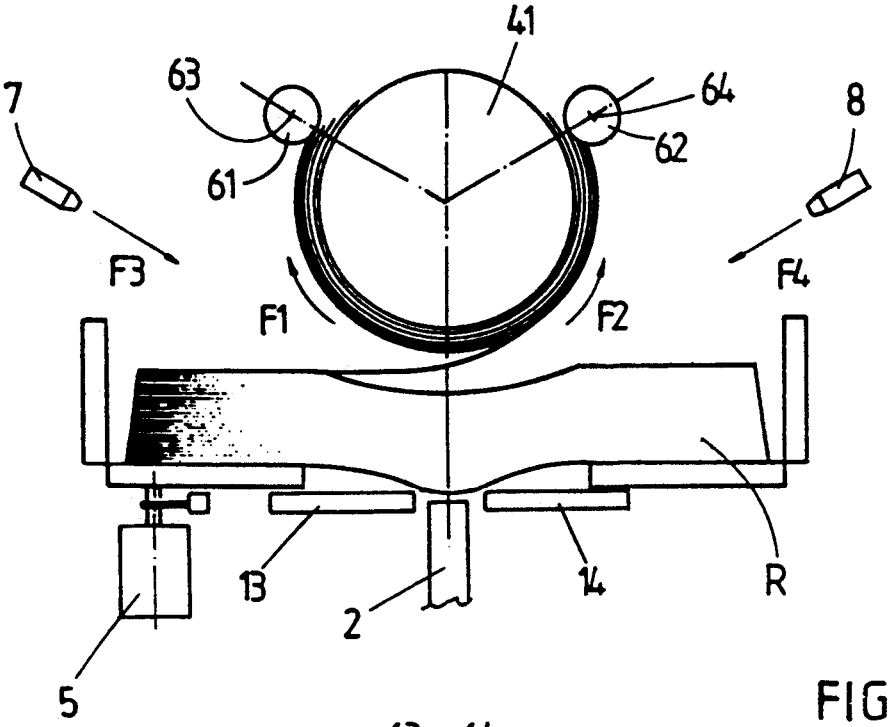
FIG. 4 shows the separating rollers close to their final position and the landing of the sheets on the board.

As shown in FIG. 2, after the pusher P has been withdrawn and the element 15 raised, the elements 13 and 14 are lowered and moved away from each other below the board 1. Simultaneously, the piston 2, acting as a bearing surface, holds up the ream R against the cylinder 41 serving as a guide for the rise of the two rollers 61 and 62 (FIG. 2). The rollers 61 and 62 then lift up the ream R, under the action of the jacks 44, 44', 45, 45' and press it against the cylinder 41 with a constant force. When the two rollers 61 and 62 are holding up the paper, the piston 2 is lowered again (FIG. 3). Under the action of the motors 55, 56, the roller 61 moves away from the roller 62 in the direction of the arrow F1, whereas the roller 62 moves symmetrically in the direction of the arrow F2 (FIG. 4). Under the effect of the deformation, the sheets of the ream slide over each other, plane on plane, on account of the difference in the radii of curvature, which vary from the first to the last sheet; their edges are thus offset, this offset being parallel to the generatrices of the cylinder 41 and to the generatrices of the rollers 61, 62.

When a roller 61, 62 passes beyond the edge of the last sheet, the latter is detached from the ream and lands in the direction of the board, as shown in FIG. 4. As the movement of the roller continues, the sheets are separated one after the other from the rest. Simultaneously, or with a time delay, the same phenomenon occurs on the other side, under the effect of the movement of the second roller. Since the drop height in the central part of the sheets is small in relation to their dimension, as shown in FIG. 4, the sheets land on the board 1, reforming a stack which is substantially rectangular, although irregular. The method may be accelerated, and the aeration of the sheets improved, by insufflating air via nozzles 7 and 8 in the direction of the arrows F3, F4, of FIG. 4 between the sheets after they have been detached from the rest of the ream pressed against the cylinder 41.

At the same time, or after the sheets have dropped, the board 1 is lowered on one side with the aid of the jack 3 and the elements 13, 14 are closed; under the effect of the tilt and of a vibrating movement created by the unbalanced mass 6 rotationally driven by the motor 5, the ream R is jogged against the raised rim 15, that is to say made uniform, as shown in FIG. 5.

Next, the ream is pushed with the aid of a pusher P' (FIG. 6) in a direction F', perpendicular to the entry direction F (FIG. 1), on a feed table in order to feed, for example, a printing machine.

The invention is not limited to the embodiment described above and illustrated in the accompanying figures. Its scope extends to alternative embodiments providing the same functions. By way of non-limiting examples: the cylinder 41 shown in the figures is a cylinder of revolution, of circumference slightly greater than the dimension of the sheets of paper. Any other shape of the directrix (fraction of circle, ellipse, parabola, etc.) of the cylindrical surface providing a difference in radii of curvature between the first and the last sheet of the ream may be used;

the rollers 61 and 62 have been shown as solid rollers, the diameter of which is less than the thickness of the ream; they may assume other shapes, for example they may be equipped with transverse grooves enabling air to be insufflated tangentially to the sheets starting to be detached;

the rollers 61 and 62 may be actuated by screw jacks, etc.; their angular movement may be effected by a multiple-transmission motor or a plurality of independent motors about coaxial axes; they may be replaced by any mechanical device enabling a bar to be rolled or to slide in a continuous movement over the edge of the curved ream;

the pushers P, P' may be replaced by any manipulator arm or suitable conveyor system.

The person skilled in the art is capable of developing other alternative embodiments of the device without departing from the scope of the protection claimed.

I claim:

1. A method for separating the sheets of paper stacked vertically in reams of sheets, by applying the ream against a curved surface in order to separate the sheets of this ream, in which method, while the ream is being applied against the said curved surface, pressure forces are exerted against the uppermost sheet of said ream along at least one line of application parallel to the generatrices of the curved surface, said line of application is moved perpendicularly to the generatrices of the curved surface over the entire length of the ream and then beyond each of the edges of the sheets, thereby releasing the sheets, the intensity of said pressure forces remaining sufficient, during sheet movement, to keep the sheets against the curved surface, the speed of said movement being adjusted so that the released sheets successively move away from the remaining curved sheets, thereby re-establishing a plane ream, and this formed ream is jogged.

2. The method as claimed in claim 1, wherein a convex, cylindrical surface is used as the curved surface.

3. The method as claimed in claim 1, wherein there are two lines of application of the pressure forces, which are moved to just beyond the portion of the curves surfaces on which the ream is applied.

4. The method as claimed in claim 3, wherein the uppermost sheet has a middle and the two lines of application are moved from the middle of the uppermost sheet in opposite directions.

5. The method as claimed in claim 1, wherein the ream is initially supported on a board and arranged so that the movement of said pressure means beyond the edges of the sheets of the ream causes these sheets to land on top of each other on said board in a stack and wherein said stack forming the ream is jogged with the aid of a mechanical jogging means.

6. Method as claimed in claim 1, wherein air is insufflated between the edges of the sheets when they are released from the pressure forces.

7. A device for implementing the method as claimed in claim 1, which comprises a jogging table (1) supporting sheets of paper stacked vertically in reams of sheets comprising, in the middle, an openable zone (17), a deforming cylinder (41) providing a curved surface for cooperating in separating the sheets of the ream located at some distance above this table and the generatrices of which are substantially parallel to the plane of this table, movable pressure means providing pressure forces comprising at least two rotary and movable separating rollers (61, 62), the axis of rotation (63, 64) of which is parallel to the generatrices of said deforming cylinder (41), these rollers being installed in order to be moved with respect to the deforming cylinder from an initial position below the ream (R) into said openable zone (17) of the table (1), over trajectories parallel to the surface of the cylinder and in order also to be moved in the radial direction with respect to said cylinder;

control means (44, 44'; 45, 45'; 56, 56') for controlling the movements of said separating rollers (61,62).

means for insufflating air directed against the edges of the released sheets parallel to the generatrices of said cylinder and jogging means (3) for jogging the stack of sheets forming the ream.

8. The device as claimed in claim 7, wherein said separating rollers (61, 62) are each connected to two jacks (44, 44'; 45, 45') installed so as to rotate about the axis (43) of said deforming cylinder (41).

9. The device as claimed in claim 7, wherein, in said openable zone (17) of the jogging table (1), a retractable part in the form of a piston (2), which can move between a low position, releasing said zone, and a high position in which it is pressed against the lower surface of said ream, is installed.

* * * * *